US010714863B2

(12) United States Patent
Miyamura et al.

(10) Patent No.: US 10,714,863 B2
(45) Date of Patent: Jul. 14, 2020

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/495,252

(22) PCT Filed: Feb. 28, 2018

(86) PCT No.: PCT/JP2018/007385
§ 371 (c)(1),
(2) Date: Sep. 18, 2019

(87) PCT Pub. No.: WO2018/173658
PCT Pub. Date: Sep. 27, 2018

(65) Prior Publication Data

US 2020/0091648 A1 Mar. 19, 2020

(30) Foreign Application Priority Data

Mar. 21, 2017 (JP) ..... 2017-053950

(51) Int. Cl.
*H01R 13/502* (2006.01)
*H01R 13/453* (2006.01)
(Continued)

(52) U.S. Cl.
CPC ..... *H01R 13/4538* (2013.01); *H01R 13/502* (2013.01); *H01R 13/44* (2013.01); *H01R 13/631* (2013.01)

(58) Field of Classification Search
CPC .. H01R 13/4538; H01R 13/502; H01R 13/44; H01R 13/631
See application file for complete search history.

(56) References Cited

U.S. PATENT DOCUMENTS 6,692,274 B2 * 2/2004 Maegawa ..... H01R 13/62933 439/157
6,939,163 B2 * 9/2005 Fujita ..... H01R 13/4538 439/374
(Continued)

FOREIGN PATENT DOCUMENTS

JP 119090 9/1977
JP 6-333629 12/1994
JP 2015-090786 5/2015

OTHER PUBLICATIONS

International Search Report dated Mar. 27, 2018.

*Primary Examiner* — Tho D Ta
(74) *Attorney, Agent, or Firm* — Gerald E. Hespos; Michael J. Porco; Matthew T. Hespos

(57) ABSTRACT

A male connector (10) includes a male terminal supporting body (30) and a male terminal covering body (50) slidable relative to each other, and a male housing (70) capable of accommodating the male terminal supporting body (30) and the male terminal covering body (50). The male terminal covering body (50) is relatively slidable to a protection position where a covering part (66) covers male tabs (22) and an exposed position where the covering part (66) exposes the male tabs (22). A female connector (100) includes female terminal fittings (120) to be fit into a receptacle (72) and connected to the male tabs (22) at the
(Continued)

time of fitting, and has a pressing surface (133) configured to displace the covering part (66) toward the exposed position by pressing the covering part (66) in the process of fitting the female connector into the receptacle (72).

3 Claims, 18 Drawing Sheets

(51) Int. Cl.
*H01R 13/44* (2006.01)
*H01R 13/631* (2006.01)

(56) References Cited

U.S. PATENT DOCUMENTS 7,249,958 B2 * 7/2007 Ishikawa ..... H01R 13/631
439/140
7,448,888 B2 * 11/2008 Okano ..... H01R 13/4538
439/157
2015/0333431 A1 * 11/2015 Gerwatowski ..... H01R 13/4538
439/141

* cited by examiner

CONNECTOR

BACKGROUND

Field of the Invention

The present invention relates to a connector.

Related Art

Japanese Unexamined Patent Publication No. H06-333629 discloses a connector with a female connector and a male connector. The male connector includes a terminal supporting body supporting a male terminal and a main body for accommodating the terminal supporting body. The male terminal is formed such that a male tab projects forward. The female connector includes a housing provided with a cavity for accommodating a female terminal. When the female connector and the male connector are connected, the male tab of the male terminal is received into the female terminal to be connected electrically.

In accommodating the terminal supporting body into the main body, the male tab may interfere with an outer wall of the main body to be fractured or broken. In view of this, it is considered to structure a terminal covering body relatively slidable between a protection position for protecting the male tab and an exposed position for exposing the male tab with respect to the terminal supporting body. The terminal covering body is at the protection position in accommodating the terminal supporting body into the main body and the terminal covering body is at the exposed position in connecting the female connector and the male connector. However, if an operation of displacing the terminal covering body to the exposed position is performed separately so that the female terminal and the male terminal are connectable to each other prior to the connection of the female connector and the male connector, working man-hours are increased and work efficiency is deteriorated.

The invention was completed on the basis of the above situation and aims to provide a connector capable of improving work efficiency.

SUMMARY

The invention is directed to a connector with a male connector and a female connector connectable to each other. The male connector includes a male terminal supporting body, a male terminal covering body and a male housing capable of accommodating the male terminal supporting body and male terminal covering body. The male terminal supporting body and the male terminal covering body are slidable relative to one another. The male connector further includes a male terminal fitting having a body part supported in the male terminal supporting body and a male tab projecting from the body part. The male terminal covering body is slidable to a protection position for covering the male tab by a covering part and an exposed position for exposing the male tab. The male housing includes a receptacle configured to surround the covering part of the male terminal covering body at the protection position with the male terminal supporting body and the male terminal covering body accommodated in the male housing. The female connector includes a female terminal fitting to be fit into the receptacle and connected to the male tab at the time of fitting and has a pressing surface configured to displace the terminal covering body toward the exposed position by pressing the covering part in the process of fitting the female connector into the receptacle.

The male tab is protected by the covering part of the male terminal covering body when the male terminal covering body is at the protection position. Thus, the fracture or breakage of the male tab can be prevented.

When the female connector and the male connector are connected, the covering part retreats to the exposed position, and the female terminal fitting and the male terminal fitting can be connected. In this case, the covering part is pressed by the pressing surface of the female connector and displaced toward the exposed position in the process of fitting the female connector into the receptacle. Thus, a displacing operation of the male terminal supporting body to the exposed position is linked with a connecting operation of the female connector and the male connector. A special operation and tool for displacing the male terminal supporting body to the exposed position can be omitted, and work efficiency can be improved.

The male terminal covering body may be provided with an engaging portion, and the female connector may be provided with an engaged portion configured to be engaged with the engaging portion in a direction separating from the receptacle and to displace the male terminal covering body toward the protection position by a separating operation from the receptacle.

The male tab may interfere with the male housing if the male terminal covering body is left at the exposed position when the male terminal supporting body and the male terminal covering body are taken out from the male housing after the female connector and the male connector are separated. Thus, the male tab may interfere with the male housing. Further, work is large if the male terminal supporting body is displaced to the protection position after the male terminal supporting body and the male terminal covering body are taken out. In that respect, according to the above-described configuration, the engaged portion that is engaged with the engaging portion by a separating operation of the female connector from the receptacle displaces the male terminal covering body toward the protection position when the female connector and the male connector are separated. Thus, when the male terminal supporting body and the male terminal covering body are taken out from the male housing, the male terminal covering body can automatically return to the protection position. Accordingly, a special operation and tool for displacing the male terminal covering body to the protection position can be omitted, and the male tab can be protected quickly.

One of the male terminal supporting body and the male terminal covering body may be provided with a deflectable and deformable semi-locking portion and the other may be provided with a restricting portion configured to be locked to an interfering portion of the semi-locking portion at the exposed position for restrict a relative displacement of the male terminal covering body to the protection position. The restricting portion may be separated from the interfering portion when the male terminal covering body is at the protection position.

According to this configuration, when the male terminal covering body is at the exposed position, inadvertent relative sliding of the male terminal supporting body and the male terminal covering body can be prevented. Further, the restricting portion is separated from the interfering portion when the male terminal covering body is at the protection position. Thus, frictional resistance generated between the male terminal supporting body and the male terminal covering body becomes excessive when the male terminal covering body slides, and the smoothness of relative sliding can be ensured.

DETAILED DESCRIPTION

Figure 1:
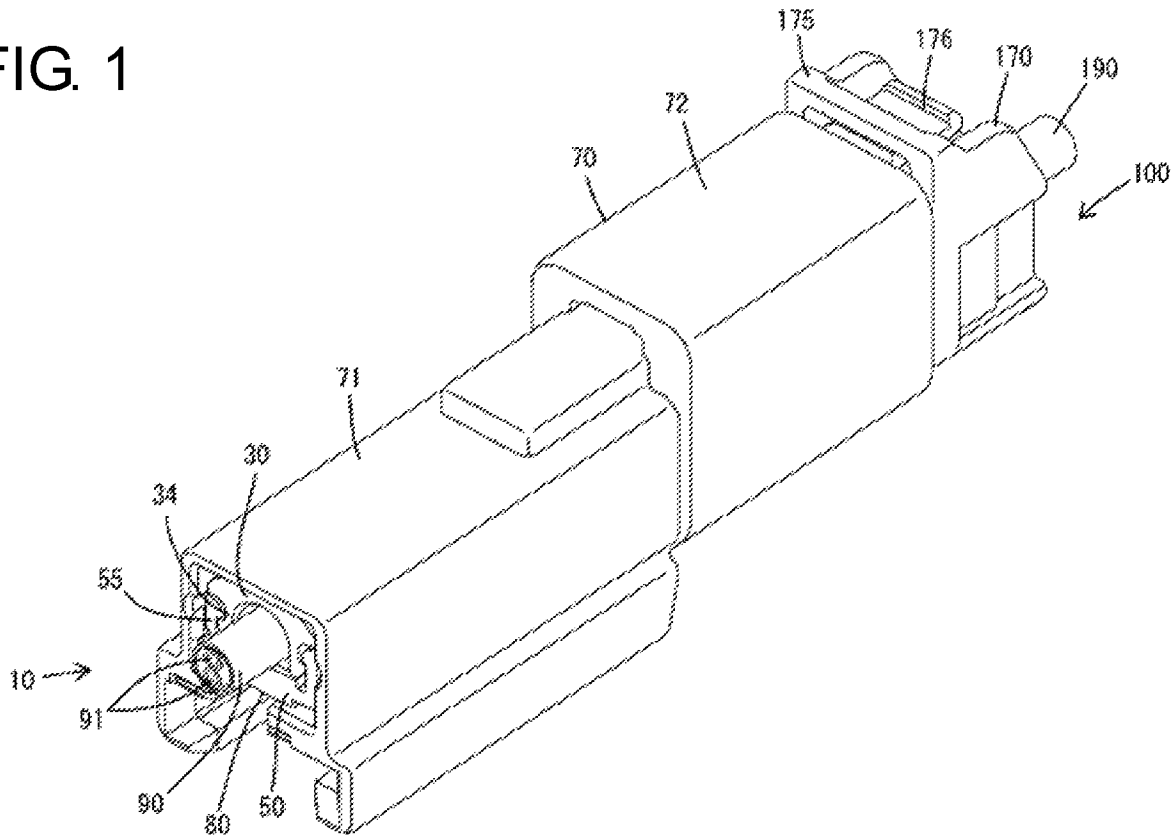
FIG. 1 is a perspective view showing a state where a female connector and a male connector are properly connected in one embodiment of the present invention.
Figure 2:
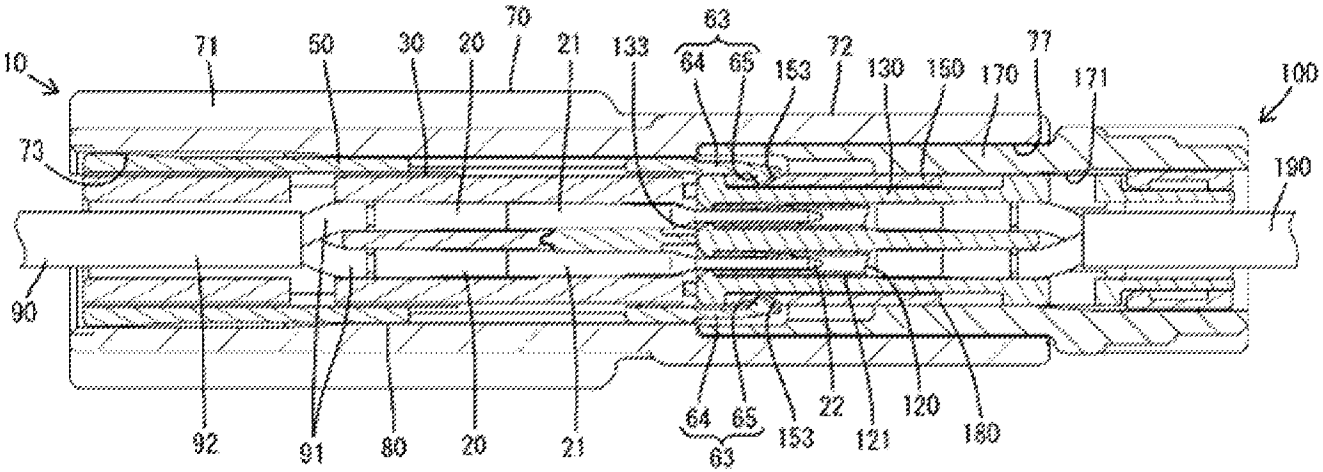
FIG. 2 is a section showing the state where the female connector and the male connector are properly connected.

An embodiment of the invention is described on the basis of FIGS. 1 to 18. This embodiment illustrates a connector constituting a communication system equipped in an automotive vehicle and includes, as shown in FIG. 2, a female connector 100 and a male connector 10 connectable to each other.

Figure 5:
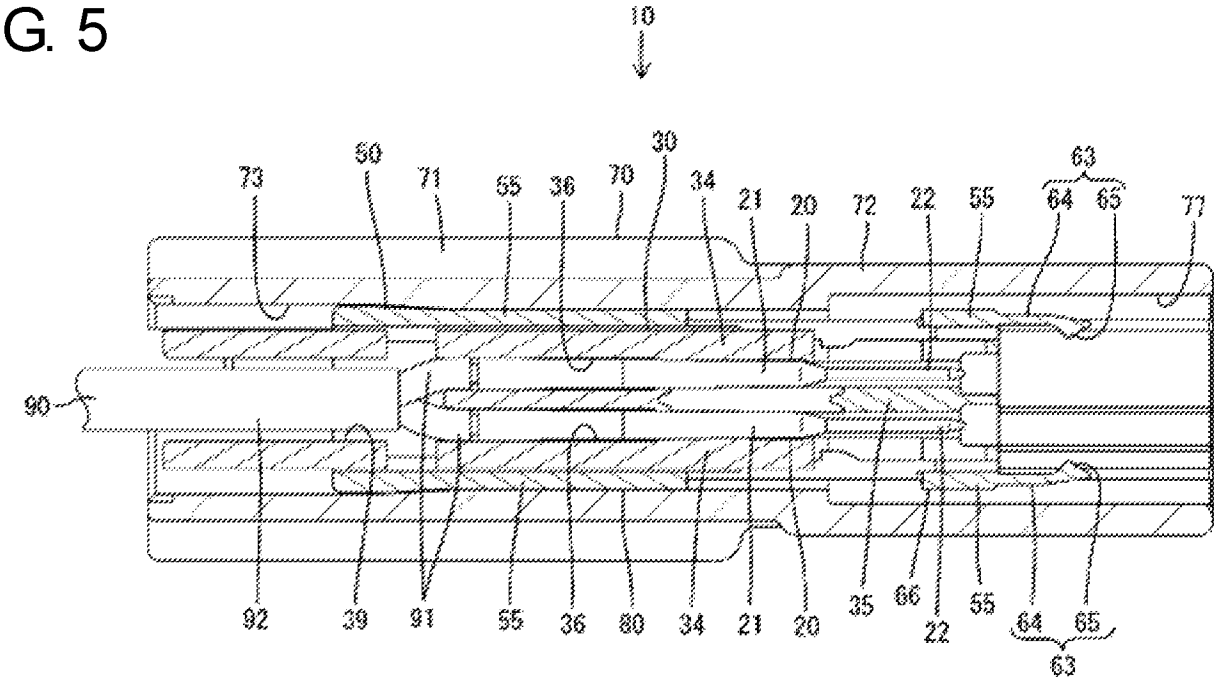
FIG. 5 is a section of the male connector.
Figure 6:
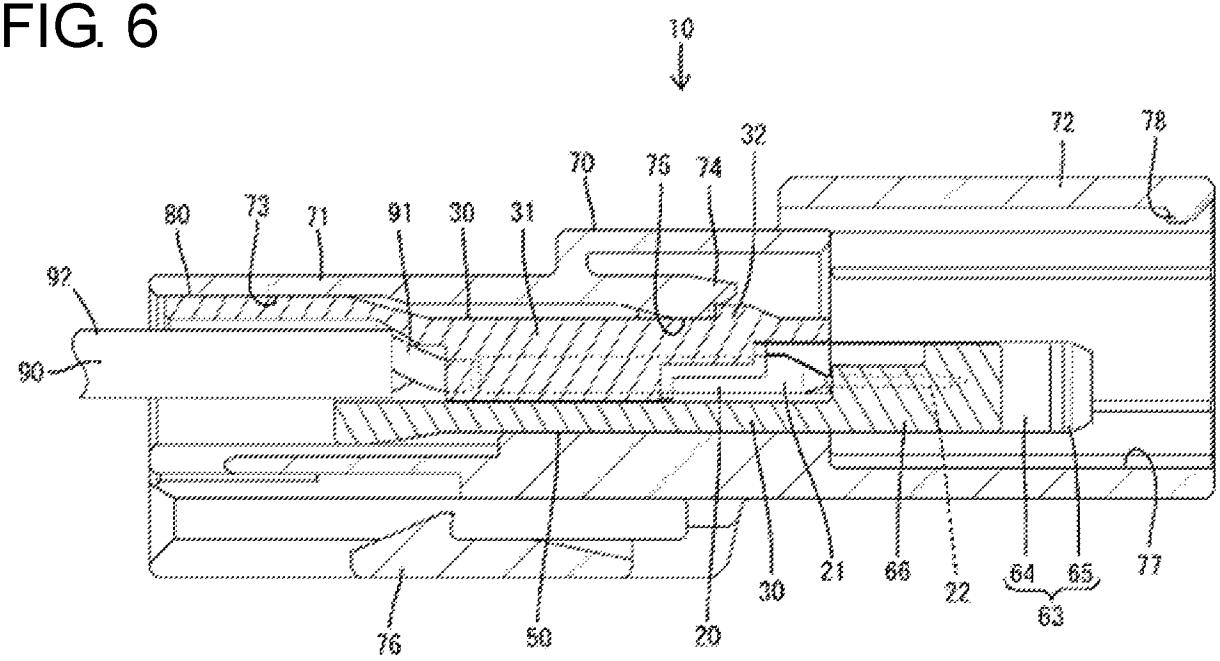
FIG. 6 is a side view in section of the male connector.

As shown in FIGS. 5 and 6, the male connector 10 includes male terminal fittings 20, a male terminal supporting body 30, a male terminal covering body 50 and a male housing 70. The male terminal fittings 20 are supported in the male terminal supporting body 30. The male terminal supporting body 30 and the male terminal covering body 50 are assembled slidably relative to one another in a front-rear direction. The assembled male terminal supporting body 30 and male terminal covering body 50 are inserted into the male housing 70 along the front-rear direction. The structure of each component is described below.

The male terminal fitting 20 is formed integrally such as by bending a conductive metal material and includes an elongated male tab 22 projecting forward from a tubular body part 21 and connected to an end part of a cable 90 in a rear of the body part 21, as shown in FIG. 5. The cable 90 is a twisted pair cable in which two wires 91 are twisted. The two wires 91 are untwisted in a part where a coating 92 is removed, and the male terminal fittings 20 are connected to the untwisted part.

Figure 7:
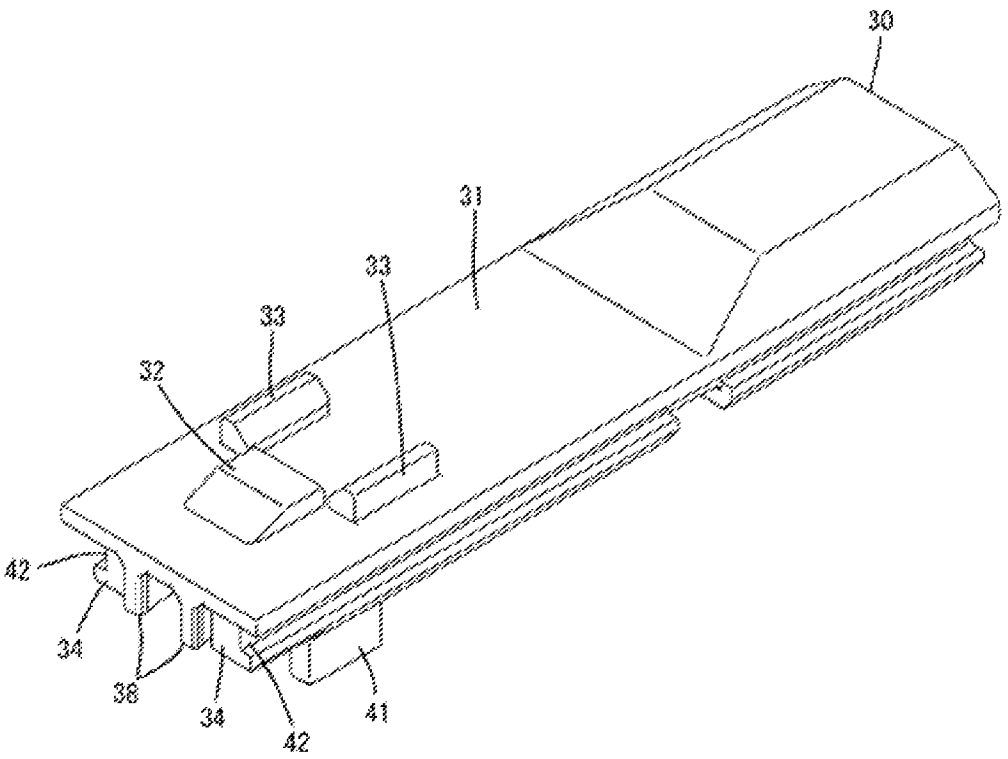
FIG. 7 is a perspective view of a male terminal supporting body viewed from above.
Figure 8:
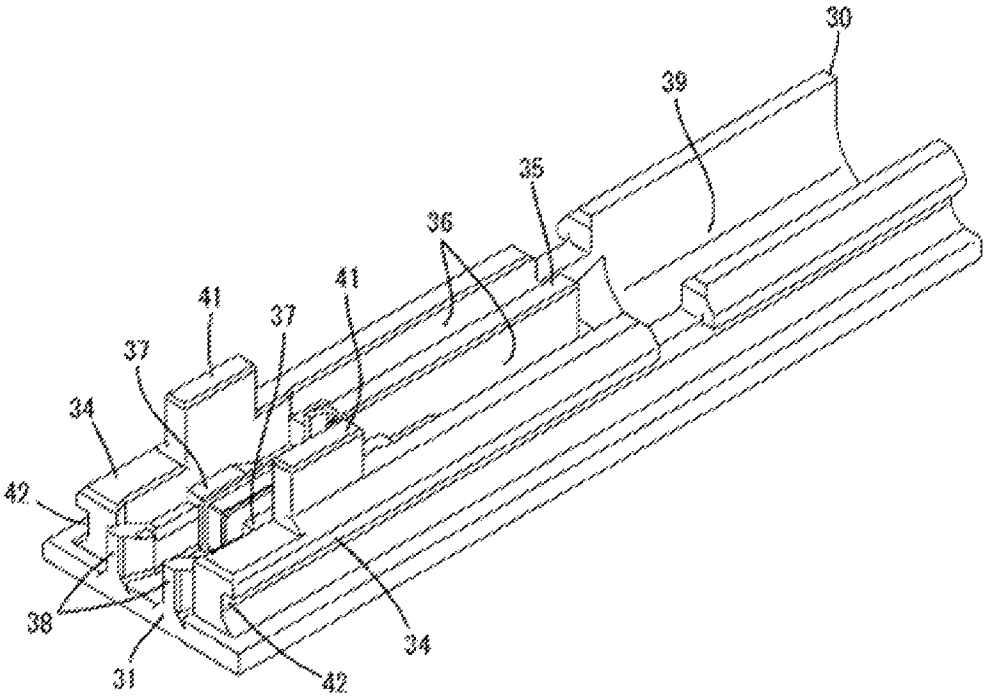
FIG. 8 is a perspective view of the male terminal supporting body viewed from below.

The male terminal supporting body 30 is a dielectric made of synthetic resin and includes, as shown in FIGS. 7 and 8, a supporting body 31 in the form of a rectangular plate long in the front-rear direction. As shown in FIG. 7, a housing lock 32 projects on a front part of the upper surface of the supporting body 31, and two forward movement restricting portions 33 project at both left and right sides of and behind the housing lock 32. Note that a vertical direction in the description is based on a state of FIG. 6 where the male terminal supporting body 30 and the male terminal covering body 50 are accommodated in the male housing 70.

As shown in FIG. 8, two rails 34 extend in the front-rear direction on both left and right end parts of the lower surface of the supporting body 31, and a partition 35 extends in the front-rear direction in a laterally central part. Left and right male terminal insertion spaces 36 are defined by the respective rails 34, the partition 35 and the supporting body 31 in the male terminal supporting body 30.

As shown in FIG. 5, the male terminal fittings 20 are inserted and accommodated into the respective male terminal insertion spaces 36 of the male terminal supporting body 30. As shown in FIG. 8, terminal retaining portions 37 project on the lower surface of the supporting body 31 for retaining the bodies 21 of the male terminal fittings 20 accommodated into the respective male terminal insertion spaces 36 and supporting pieces 38 capable of supporting the male tabs 22 of the respective male terminal fittings 20.

One cable end insertion space 39 is defined behind the partition 35 by the supporting body 31 and the respective rails 34 in the male terminal supporting body 30. An end part of the coating 92 of the cable 90 is accommodated into the cable end insertion space 39. Since the respective male terminal insertion spaces 36 are located immediately in front of the cable end insertion space 39, a length of the untwisted part from the end part of the coating 92 of the cable 90 to a connected part to the male terminal fittings 20 becomes shorter and communication performance can be improved. Note that the male terminal fittings 20 inserted into the respective male terminal insertion spaces 36 are substantially fixed in the male terminal supporting body 30 and behave integrally with the male terminal supporting body 30.

As shown in FIG. 8, two restricting portions 41 in the form of rectangular plates project down on lower end front parts of the respective rails 34. Further, guide grooves 42 having a recessed cross-section extend in the front-rear direction in outer left and right surfaces of the respective rails 34.

Figure 9:
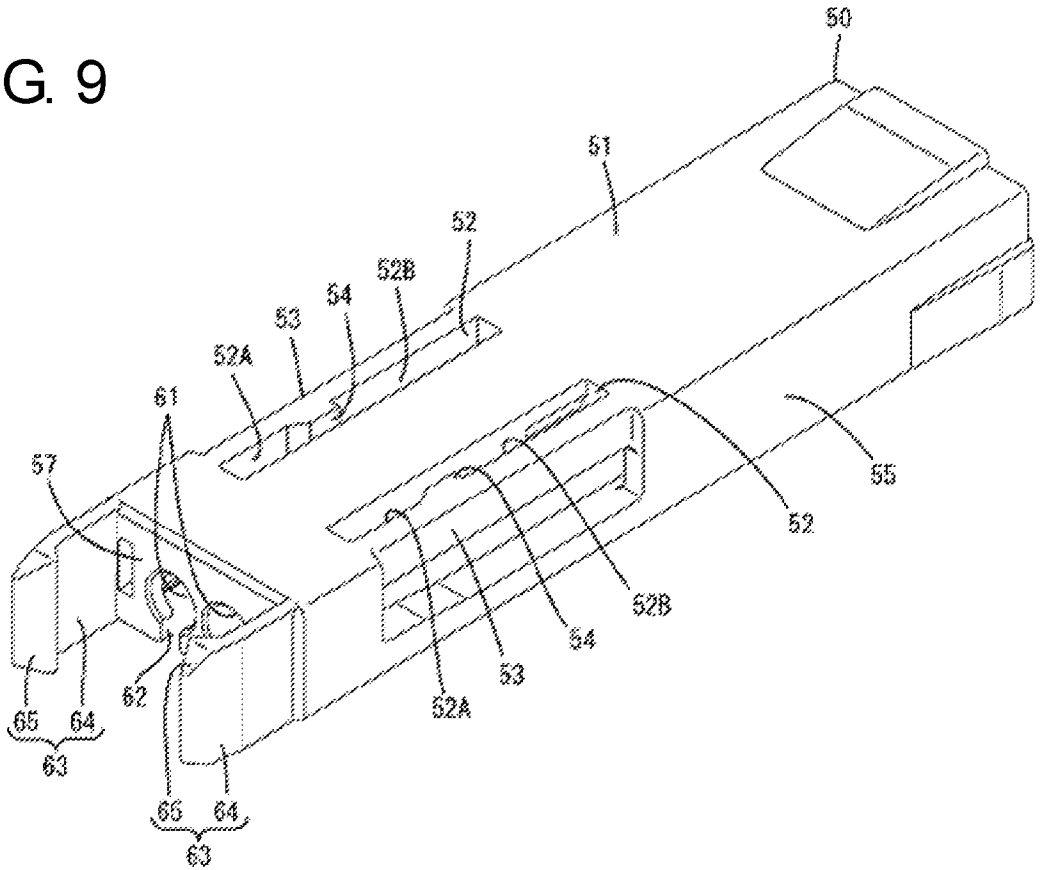
FIG. 9 is a perspective view of a male terminal covering body viewed from below.
Figure 10:
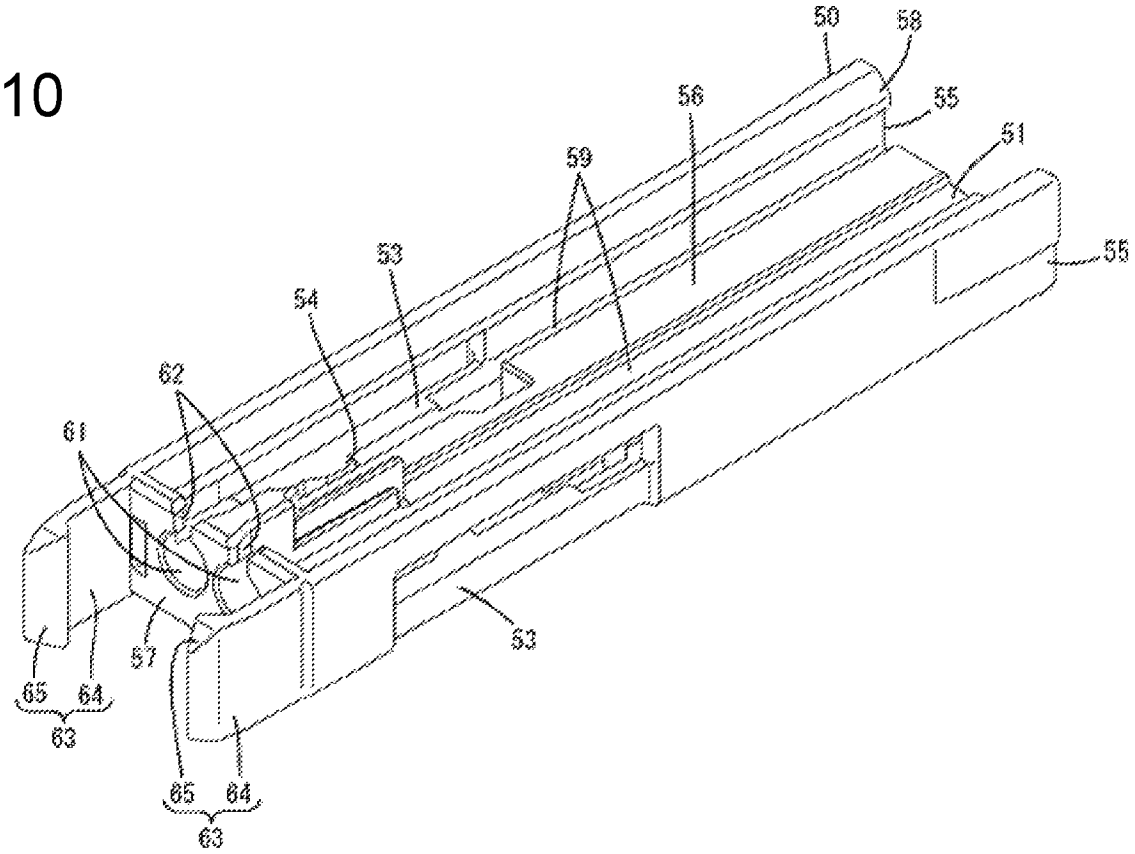
FIG. 10 is a perspective view of the male terminal covering body viewed from above.

The male terminal covering body 50 is a dielectric made of synthetic resin and includes, as shown in FIGS. 9 and 10, a covering body 51 in the form of a rectangular plate long in the front-rear direction. As shown in FIG. 9, two through grooves 52 elongated in the front-rear direction penetrate through both left and right end parts of the covering body 51. Left and right outer ends of the respective through grooves 52 are defined by two semi-locking portions 53 in the covering body 51. Each semi-locking portion 53 is a beam supported on both ends and elongated in the front-rear direction, and includes an interfering portion 54 protruding to narrow a groove width of the through groove 52 at a position near a front end. Each semi-locking portion 53 is deflected and deformed outward in an arched manner to allow a relative displacement of the restricting portion 41 in the through groove 52 when the restricting portion 41 interferes with the interfering portion 54.

The front surface of each interfering portion 54 is inclined with respect to the front-rear direction and the rear surface thereof is arranged substantially at a right angle to the front-rear direction. A front groove part 52A of each through groove 52 is shorter in the front-rear direction than a rear groove part 52B thereof and has an opening length substantially equal to a length of the interfering portion 54 in the front-rear direction (see FIG. 14).

As shown in FIG. 10, two side walls 55 extend in the front-rear direction on both left and right end parts of the upper surface of the covering body 51, a separation wall 56 extends in the front-rear direction in a laterally central part and a front wall 57 connected to the front ends of the respective side walls 55 and the separation wall 56 extends in a lateral direction on a front end part.

Figure 4:
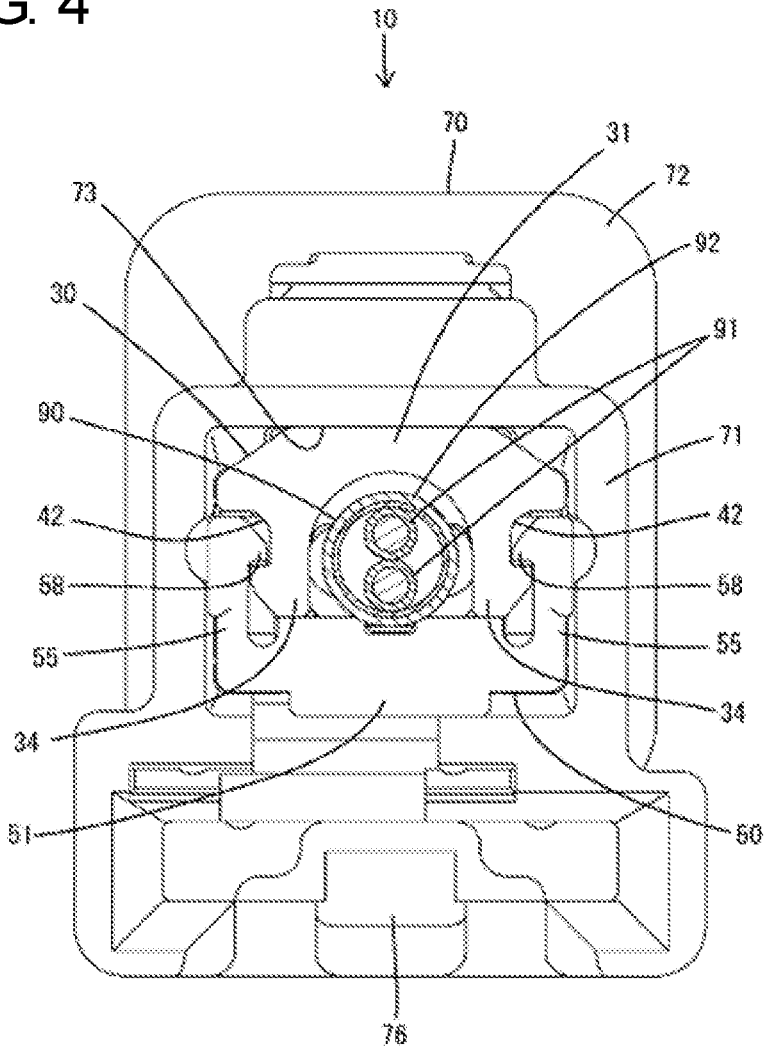
FIG. 4 is a back view of the male connector.

The respective side walls 55 are cut in parts corresponding to the respective semi-locking portions 53 and are located outwardly of the respective semi-locking portions 53 in the lateral direction. The respective semi-locking portions 53 can be deflected and deformed into spaces retracted inwardly of the outer surfaces of the respective side walls 55. Guides 58 project in on upper end parts of the respective side walls 55. As shown in FIG. 4, the respective guides 58 can enter the respective guide grooves 42 and slide in the guide grooves 42, thereby making the male terminal supporting body 30 and the male terminal covering body 50 relatively slidable.

Figure 15:
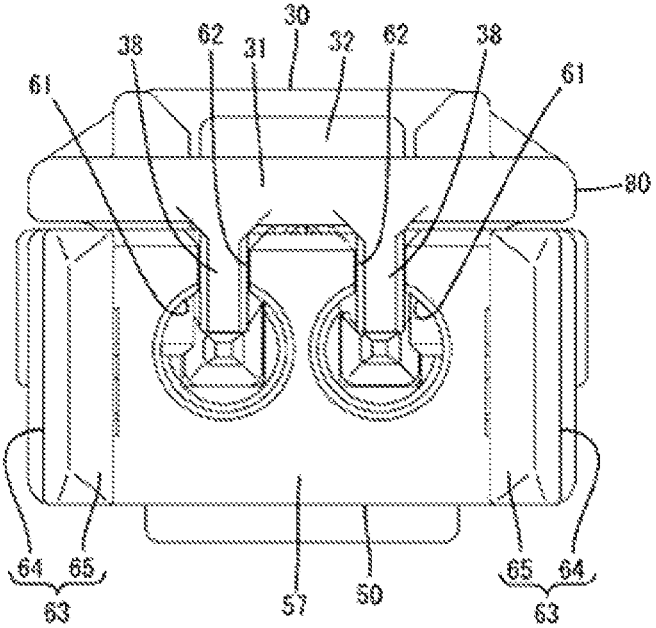
FIG. 15 is a front view of the male unit in which the male terminal covering body is at the exposed position.

As shown in FIG. 10, left and right covering spaces 59 are defined by the respective side wall 55, the separation wall 56, the front wall 57 and the covering body 51 in the male terminal covering body 50. The male terminal fitting 20 is arranged to be covered in each covering space 59. Left and right tab insertion openings 61 are open in the front wall 57, and the male tabs 22 of the respective male terminal fittings 20 can pass therethrough. Slit grooves 62 extending in the vertical direction are open in the upper end of the front wall 57 and communicate with the respective tab insertion openings 61. Each slit groove 62 serves as a passage when the male tab 22 of each male terminal fitting 20 is introduced into each tab insertion opening 61 and each supporting piece 38 of the male terminal supporting body 30 enters the slit groove 62, as shown in FIG. 15.

Figure 11:
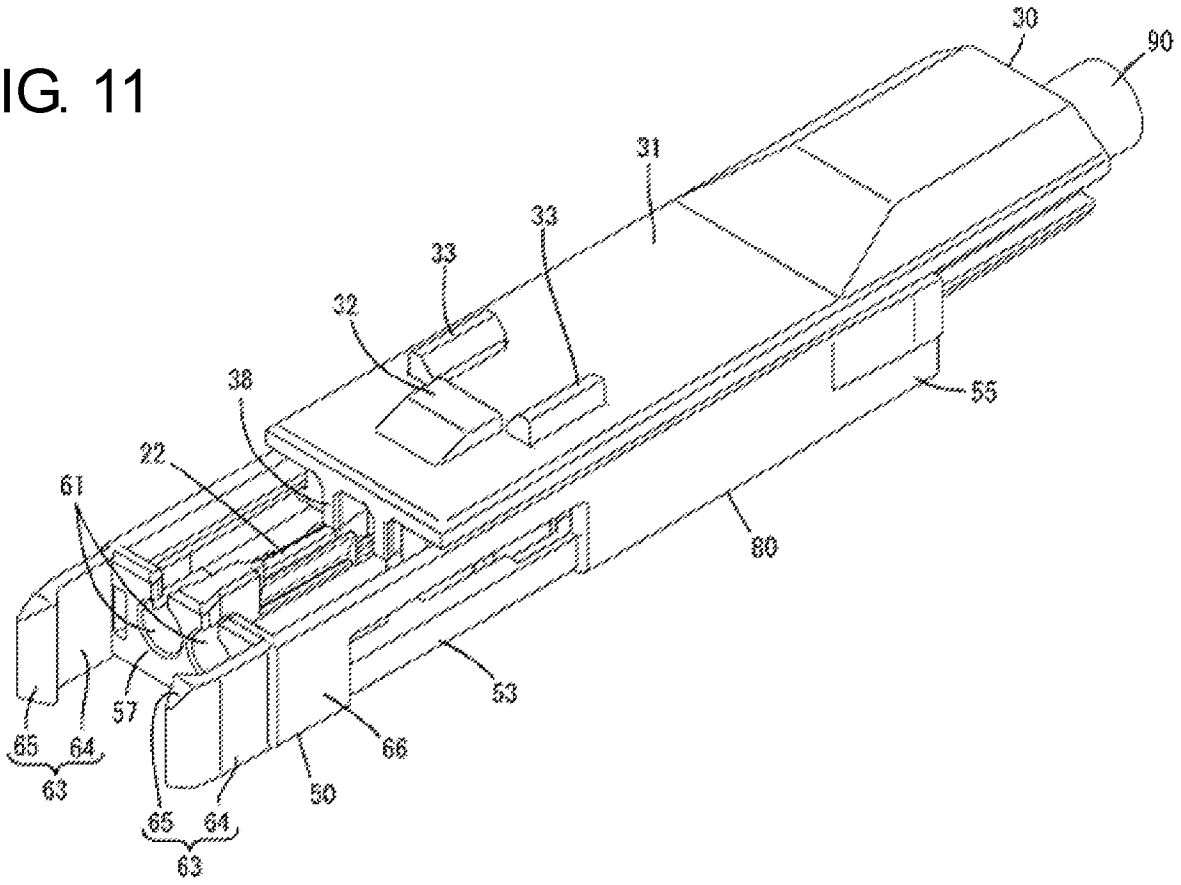
FIG. 11 is a perspective view of a male unit, in which the male terminal covering body is at a protection position, viewed from above.

As shown in FIGS. 10 and 11, two engaging portions 63 extend forward on both left and right end parts of the front wall 57. Each engaging portion 63 includes an arm 64 in the form of a plate connected to the front surface of the front wall 57 substantially over the entire length in the vertical direction and extending to have the same vertical dimension as the front wall 57 (also vertical dimension of each side wall 55), and a claw-like hook 65 projecting in from a front part of the arm 64. A front part outer surface of each arm 64 is inclined inward.

Figure 12:
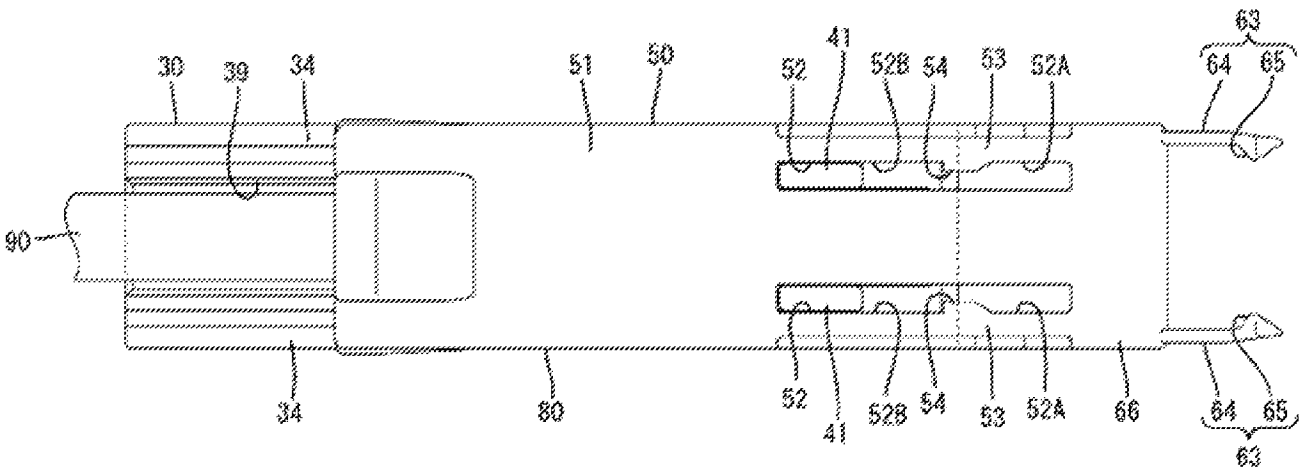
FIG. 12 is a bottom view of the male unit in which the male terminal covering body is at the protection position.
Figure 13:
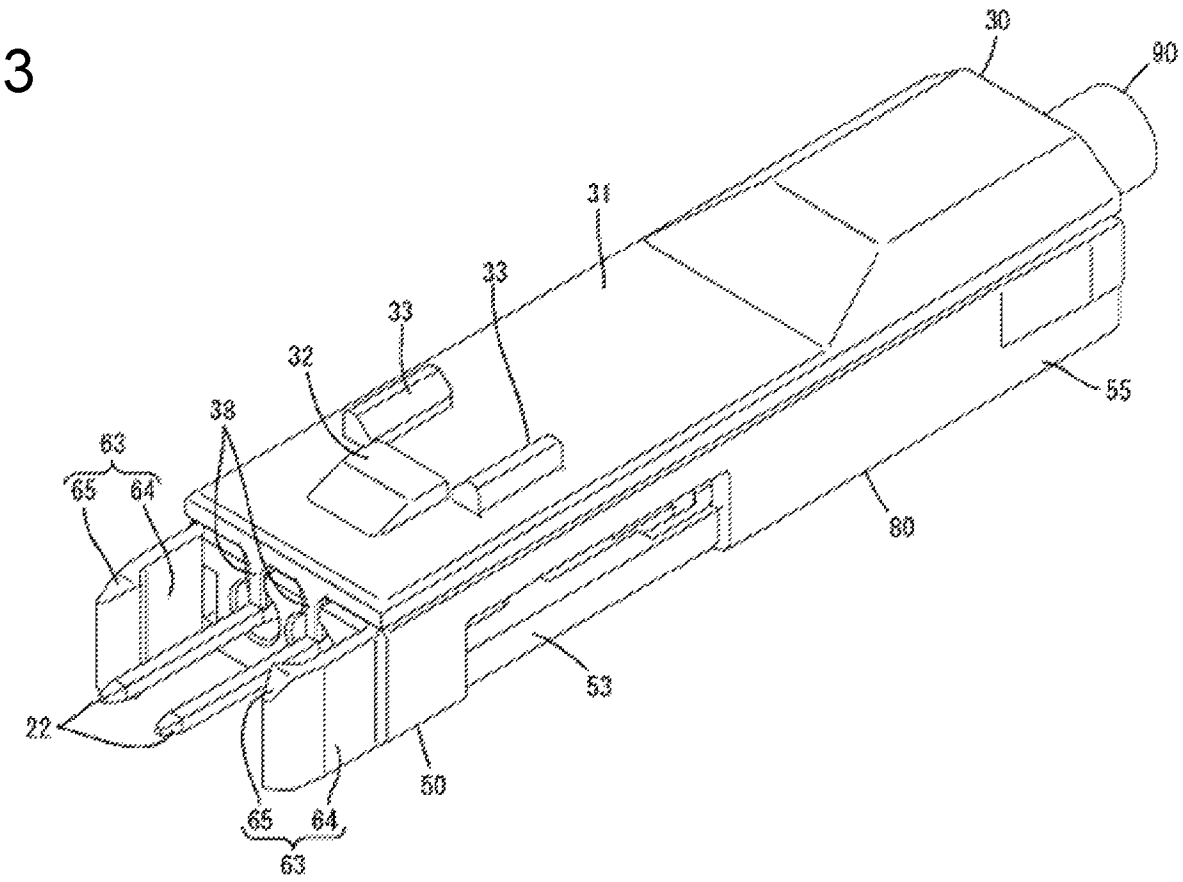
FIG. 13 is a perspective view of the male unit, in which the male terminal covering body is at an exposed position, viewed from above.

As shown in FIG. 12, the front and rear surfaces of each hook 65 are inclined with respect to the front-rear direction. A front slope of each hook 65 has a smaller angle of inclination with respect to the front-rear direction than a rear slope thereof and is long in the front-rear direction. Further, as shown in FIG. 15, upper and lower parts of the front end of each engaging portion 63 are tapered.

The male housing 70 is made of synthetic resin and, as shown in FIGS. 5 and 6, has a tubular shape penetrating in the front-rear direction. The male housing 70 includes an accommodating portion 71 and a receptacle 72 connected to the accommodating portion 71 and projecting forward.

The accommodating portion 71 has a male unit accommodation space 73 penetrating in the front-rear direction. As shown in FIG. 6, a deflectable and deformable locking lance 74 is cantilevered forward on an inner wall upper surface of the accommodating portion 71 (inner wall upper surface of the male unit accommodation space 73). A claw-like locking projection 75 projects down on a front end part of the locking lance 74. An attaching portion 76 to be attached to an unillustrated vehicle-side bracket is provided on a lower surface side of the accommodating portion 71.

The receptacle 72 is shorter in the front-rear direction than and is radially one size larger than the accommodating portion 71. A fitting space 77 penetrates the receptacle 72 in the front-rear direction and communicates with the male unit accommodation space 73. As shown in FIG. 6, a claw-like lock portion 78 projects downward on a front end part of an upper wall inner surface of the receptacle 72.

Figure 17:
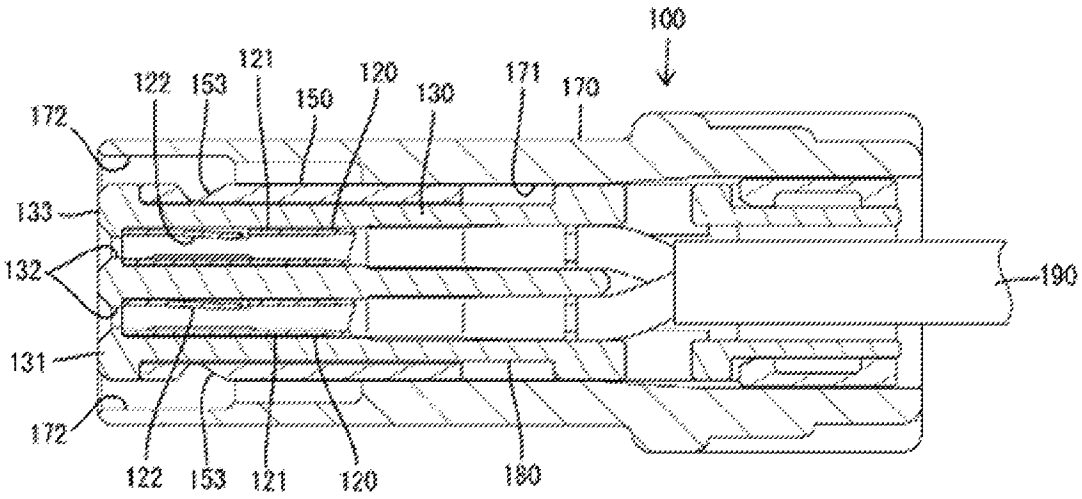
FIG. 17 is a section of the female connector.

As shown in FIG. 17, the female connector 100 includes female terminal fittings 120, a female terminal supporting body 130, a female terminal covering body 150 and a female housing 170. Similar to the male terminal fittings 20, two of the female terminal fittings 120 are connected to end parts of wires 91 constituting a cable 190 as a twisted pair cable. The female terminal fitting 120 includes a tubular part 121 for receiving the male tab 22 of the male terminal fitting 20 and a contact part 122 configured to resiliently contact the male tab 22 inside the tubular part 121.

The female terminal supporting body 130 and the female terminal covering body 150 are dielectrics made of synthetic resin and the basic structures thereof are similar to those of the male terminal supporting body 30 and the male terminal covering body 50 described above. The female terminal supporting body 130 supports the respective female terminal fittings 120, and the female terminal covering body 150 is assembled with the male terminal supporting body 130 from above to cover the respective female terminal fittings 120. Unlike the male terminal supporting body 30 and the male terminal covering body 50, the female terminal supporting body 130 and the female terminal covering body 150 are not structured to slide relative to each other.

Figure 3:
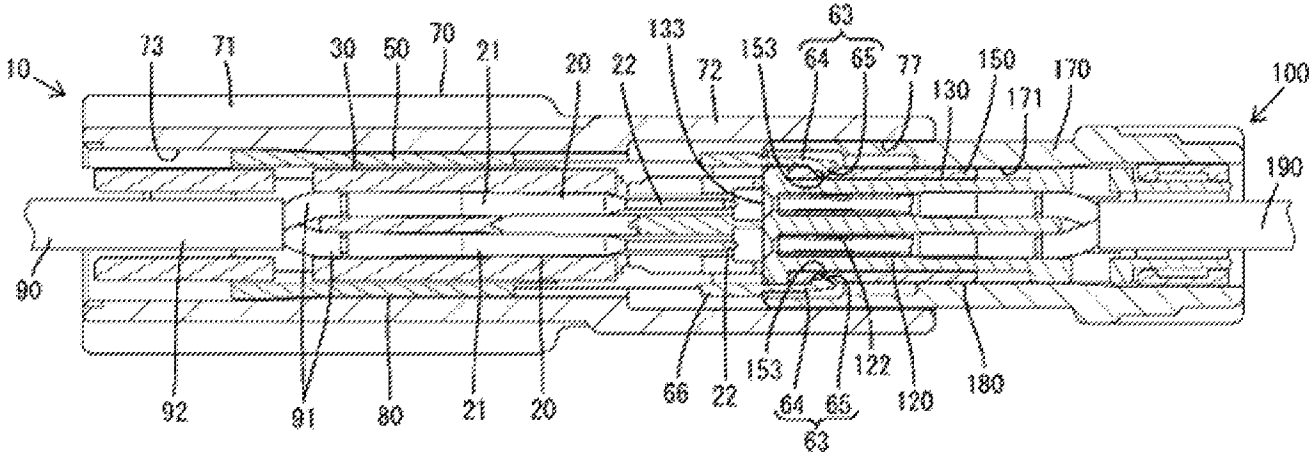
FIG. 3 is a section showing a state in the process of connecting or separating the female connector and the male connector.
Figure 18:
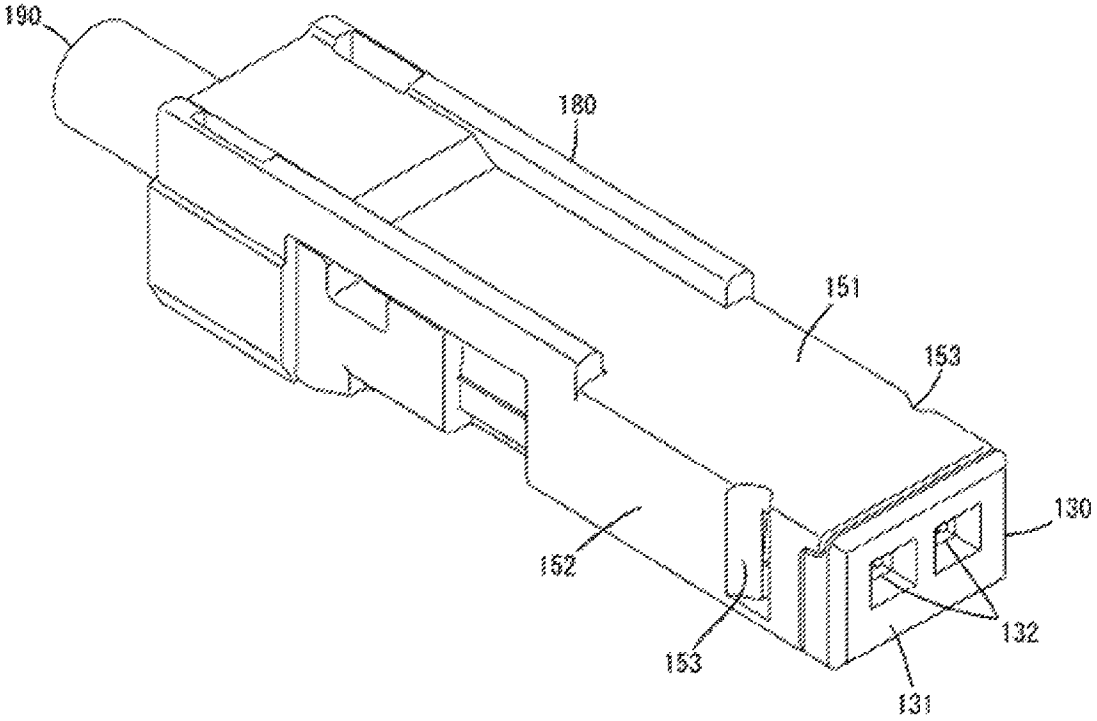
FIG. 18 is a perspective view of a female unit viewed from above.

As shown in FIG. 18, the female terminal supporting body 130 includes a front wall 131 capable of stopping the respective female terminal fittings 120 in front. The front wall 131 has two tab passage openings 132 through which the male tabs 22 of the respective male terminal fittings 20 pass. The front surface of the front wall 131 is arranged along the vertical direction substantially at the same position as the front end of the female housing 170 in the front-rear direction with the female terminal supporting body 130 accommodated in a female unit accommodation space 171 to be described later. As shown in FIG. 3, the front wall 131 is constituted as a pressing surface 133 for pressing the male terminal covering body 50 in the process of connecting the female connector 100 and the male connector 10.

As shown in FIG. 18, the female terminal covering body 150 includes an upper plate 151 for covering the female terminal supporting body 130 from above and two side plates 152 for covering both sides of the female terminal supporting body 130. The side plates 152 are provided with engaged portions 153. Each engaged portion 153 is in the form of a notched groove extending in the vertical direction and open upward and penetrates through each side plate 152 in a plate thickness direction in a front part of each side plate 152. Specifically, each engaged portion 153 has a cross-sectional shape widened from the inner surface to the outer surface of each side plate 152, and an angle of inclination of a rear slope with respect to the front-rear direction is smaller than that of a front slope, and the rear slope is longer than the front slope. In short, each engaged portion 153 has a cross-sectional shape corresponding to each hook 65 (see FIGS. 2 and 3).

The female housing 170 is made of synthetic resin and, as shown in FIG. 17, the female unit accommodation space 171 capable of accommodating the female terminal supporting body 130 and the female terminal covering body 150 penetrates in the front-rear direction inside. Two recesses 172 are provided in both inner wall side surfaces of the female housing 170 (both inner wall side surfaces of the female unit accommodation space 171). The inside of each recess 172 serves as a space for allowing each engaging portion 63 to be deflected in the process of connecting/separating the female connector 100 and the male connector 10 described later.

Figure 16:
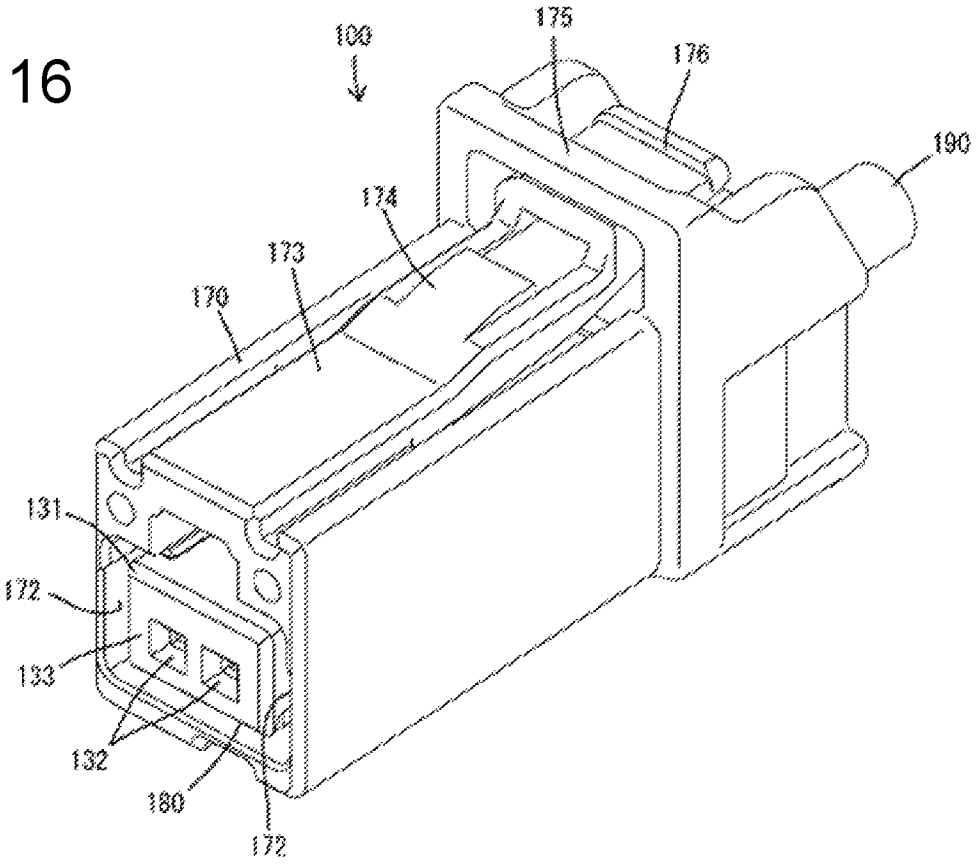
FIG. 16 is a perspective view of the female connector viewed from above.

As shown in FIG. 16, a deflectable and deformable lock arm 173 extends rearward from a front end part of an upper wall outer surface of the female housing 170. The lock arm 173 is provided with a lock projection 174 projecting upward, and a releasing portion 176 slightly raised is provided behind the lock projection 174. Further, the female housing 170 is provided with an arch 175 surrounding the releasing portion 176.

Next, functions of the connector of this embodiment are described.

In assembling the male connector 10, the male terminal fittings 20 are accommodated and held in the respective male terminal insertion spaces 36 of the male terminal supporting body 30. Subsequently, the male terminal covering body 50 is mounted on the male terminal supporting body 30. The guides 58 of the respective side walls 55 of the male terminal covering body 50 resiliently enter the guide grooves 42 of the respective rails 34 of the male terminal supporting body 30 so that the male terminal supporting body 30 and the male terminal covering body 50 are held in a separation restricted state.

Further, as shown in FIG. 12, the respective restricting portions 41 of the male terminal supporting body 30 enter rear end sides of the rear groove parts 52B of the respective through grooves 52 of the male terminal covering body 50, and the respective restricting portions 41 are arranged in a movement restricted state in the front-rear direction due to frictional resistance with groove surfaces of the respective through grooves 52. At this time, as shown in FIG. 11, the male tabs 22 of the male terminal fittings 20 project forward of the male terminal supporting body 30, but have the lower parts, both side parts and front parts thereof respectively covered by the covering body 51, the side walls 55 and the front wall 57 (hereinafter, covering part 66) in the male terminal covering body 50. In this way, the male terminal covering body 50 is kept at a protection position for protecting the male tabs 22 with respect to the male terminal supporting body 30. When the male terminal covering body 50 is at the protection position, the covering part 66 protects the male tabs 22 of the respective male terminal fittings 20.

Subsequently, the male terminal supporting body 30 and the male terminal covering body 50 assembled as described above (hereinafter, referred to as a male unit 80) are inserted into the male unit accommodation space 73 of the accommodating portion 71 of the male housing 70. At this time, the male unit 80 may be pushed into the male unit accommodation space 73 while the cable 90 extending rearward from the male terminal supporting body 30 is gripped. Since the male tabs 22 of the respective male terminal fittings 20 are covered by the covering part 66 of the male terminal covering body 50 at the protection position, the wall surface of the male housing 70 does not directly interfere with the respective male tabs 22 so that fracture or breakage of the male tabs 22 is prevented.

In the process of inserting the male unit 80 into the male unit accommodation space 73, the housing lock 32 of the male terminal supporting body 30 presses, deflects and deforms the locking lance 74. As the male terminal supporting body 30 is inserted properly into the male unit accommodation space 73, the locking lance 74 resiliently returns and, as shown in FIG. 6, the locking projection 75 is arranged to engage the housing lock 32. Further, the forward movement restricting portions 33 of the male terminal supporting body 30 contact unillustrated stoppers in the male housing 70 to restrict a movement of the male terminal supporting body 30 toward the receptacle 72. In this way, the male terminal supporting body 30 is held in a movement restricted state in the front-rear direction in the male unit accommodation space 73.

When the male terminal supporting body 30 is inserted properly into the male unit accommodation space 73, the covering part 66 of the male terminal covering body 50 projects into the fitting space 77 of the receptacle 72. In this way, covering part 66 protects the respective male tabs 22 likewise projecting into the fitting space 77. Note that the male terminal covering body 50 is slidable relative to the male terminal supporting body 30 in the male unit accommodation space 73 and the fitting space 77.

On the other hand, as shown in FIG. 18, the female terminal covering body 150 is mounted on the female terminal supporting body 130 supporting the female terminal fittings 120 and these female terminal supporting body 130 and female terminal covering body 150 (hereinafter, referred to as a female unit 180) are inserted and held in the female unit accommodation space 171 of the female housing 170 so that the female connector 100 shown in FIG. 16 is assembled.

In connecting the female connector 100 and the male connector 10, the female housing 170 of the female connector 100 is inserted into the fitting space 77 of the receptacle 72 of the male connector 10.

In the process of inserting the female housing 170 into the fitting space 77 of the receptacle 72, the pressing surface 133 of the female unit 180 faces and comes into contact with the front wall 57 of the covering part 66, as shown in FIG. 3 before a deflecting operation of the lock arm 173 is started. At this time, the hook 65 of the engaging portions 63 are fit resiliently into the respective engaged portions 153, and the engaging portions 63 are engaged with the respective engaged portions 153 to embrace the covering part 66. In this way, the female unit 180 and the male terminal covering body 50 are coupled.

As the female housing 170 is inserted farther, the male terminal covering body 50 retreats by being pressed by the pressing surface 133 of the female unit 180 and is displaced toward an exposed position with respect to the male terminal supporting body 30. At this time, the respective restricting portions 41 of the male terminal supporting body 30 are displaced toward the front groove parts 52A of the through grooves 52 of the male terminal covering body 50.

Figure 14:
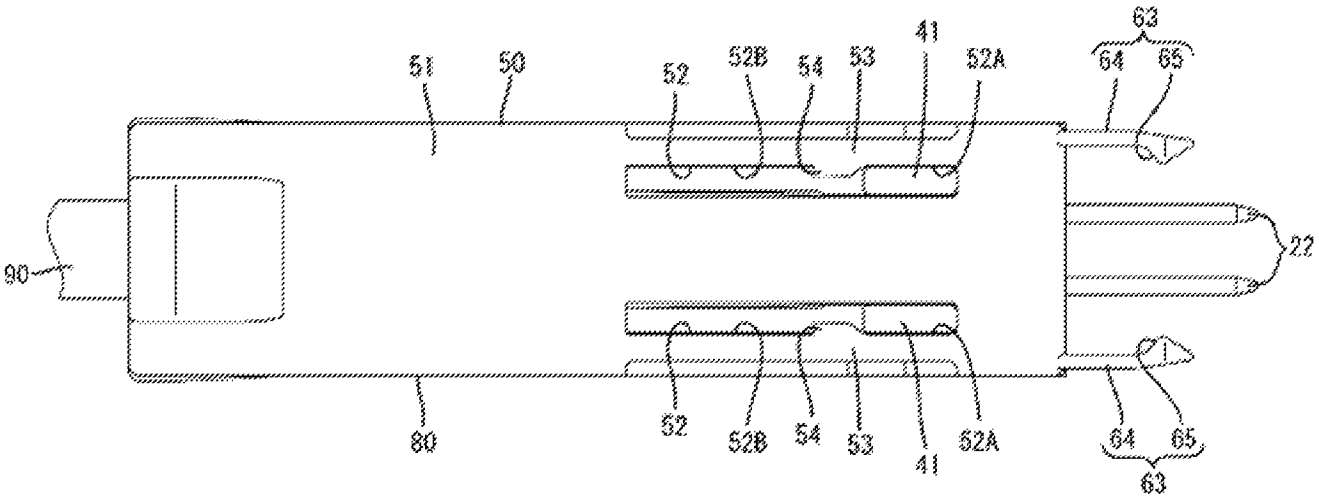
FIG. 14 is a bottom view of the male unit in which the male terminal covering body is at the exposed position.

When the female housing 170 is inserted properly into the fitting space 77 of the receptacle 72, the respective restricting portions 41 resiliently move beyond the respective interfering portions 54 and are fit and inserted into the front groove parts 52A of the respective through grooves 52, and the male terminal covering body 50 reaches the exposed position with respect to the male terminal supporting body 30 (see FIG. 14). The restricting portions 41 are arranged in a movement restricted state in the front-rear direction between the through grooves 52 and the interfering portions 54 at the exposed position. Further, as shown in FIG. 2, the pressing surface 133 of the female unit 180 faces and contacts the male unit 80 including the male terminal supporting body 30. Further, the male tabs 22 of the male terminal fittings 20 enter the female unit 180 by way of the respective tab passage openings 132 from the respective tab insertion openings 61 and are inserted into the tubular parts 121 of the respective female terminal fittings 120 to be connected.

While the covering part 66 of the male terminal covering body 50 is pressed by the female unit 180 and displaced toward the exposed position, an engaged state (hooked state) of the engaging portions 63 and the respective engaged portions 153 is maintained. Additionally, the lock arm 173 of the female housing 170 interferes with the lock 78 of the receptacle 72 to be deflected and deformed. Thereafter, as the female connector 100 and the male connector 10 are connected properly, the lock arm 173 resiliently returns and the lock projection 174 is arranged to be lockable to the lock 78. In this way, the female housing 170 is held in a separation restricted state in the receptacle 72. At this time, as shown in FIG. 1, the releasing portion 176 and the arch 175 of the lock arm 173 are exposed to outside without entering the fitting space 77 of the receptacle 72.

On the other hand, in taking out the male unit 80 from the male unit accommodation space 73 of the accommodating portion 71 due to maintenance or other reason, the releasing portion 176 is pressed from above and the lock arm 173 is deflected and deformed in an unlocking direction. The female connector 100 and the male connector 10 are pulled apart from each other with the lock arm 173 and the lock 78 unlocked from each other in this way.

In the process of separating the female connector 100 from the fitting space 77 of the receptacle 72, the hooks 65 of the respective engaging portions 63 are hooked to the respective engaged portions 153 to maintain a coupled state of the female connector 100 and the male terminal covering body 50, as shown in FIG. 3. Thus, the male terminal covering body 50 is interlocked with the female connector 100 and relatively slides toward the protection position. When the male terminal covering body 50 starts sliding, the restricting portions 41 slide along the front slopes of the respective interfering portions 54. Thus, the semi-locking portions 53 are deflected and deformed and the restricting portions 41 move to the rear groove parts 52B of the respective through grooves 52. Associated with that, the semi-locking portions 53 resiliently return.

Also when the restricting portions 41 move beyond the respective interfering portions 54, the engaged state of the engaging portions 63 and the respective engaged portions 153 is maintained and the male terminal covering body 50 is displaced toward the protection position, following the female connector 100. During this time, the restricting portions 41 smoothly displace toward the rear ends of the rear groove parts 52B of the respective through grooves 52 without interfering with the respective interfering portions 54.

The restricting portions 41 eventually reach positions where the restricting portions 41 contact the rear ends of the rear groove parts 52B of the respective through grooves 52 in the process of separating the female connector 100 from the receptacle 72 so that any additional following displacement of the male terminal covering body 50 is restricted (see FIG. 12). Associated with that, the engaging portions 63 deflect and deform in a direction to be separated from the respective engaged portions 153 and the coupled state of the female connector 100 and the male terminal covering body 50 is released.

Thereafter, when the female connector 100 is pulled apart from the receptacle 72, the male terminal covering body 50 returned to the protection position again with respect to the male terminal supporting body 30 is arranged in the male housing 70. Thereafter, the locking lance 74 is deflected and deformed in a direction to be unlocked from the housing lock 32 and, in that state, the cable 90 connected to the male terminal fittings 20 is pulled rearward so that the male unit 80 in which the male terminal covering body 50 is at the protection position is taken out from the receptacle 72. Thus, the male tabs 22 cannot interfere with the male housing 70 or the like to be fractured or broken when the male unit 80 is taken out from the receptacle 72. Further, an operation of displacing the male terminal covering body 50 to the protection position need not be performed after the male unit 80 is taken out from the receptacle 72, and a work load is mitigated.

As described above, according to this embodiment, the covering part 66 of the male terminal covering body 50 protects the male tabs 22 when the male terminal covering body 50 is at the protection position. Thus, the fracture or breakage of the male tabs 22 can be prevented.

Further, when the female connector 100 and the male connector 10 are connected, the covering part 66 of the male terminal covering body 50 retreats to the exposed position and the female terminal fittings 120 and the male terminal fittings 20 can be connected. In this case, the covering part 66 of the male terminal covering body 50 is displaced toward the exposed position by being pressed by the pressing surface 133 of the female connector 100 in the process of fitting the female connector 100 into the fitting space 77 of the receptacle 72. Thus, an operation of displacing the male terminal supporting body 30 to the exposed position is linked with an operation of connecting the female connector 100 and the male connector 10. Accordingly, a special operation and tool for displacing the male terminal supporting body 30 to the exposed position can be omitted, and work efficiency can be improved.

The male terminal covering body 50 is provided with the engaging portions 63, and the female connector 100 is provided with the engaged portions 153 to be engaged with the engaging portions 63 in a direction separating the female connector 100 from the receptacle 100. The engaged portions 153 engaged with the engaging portions 63 by the operation of separating the female connector 100 from the receptacle 72 can displace the male terminal covering body 50 to the protection position when the female connector 100 and the male connector 10 are separated. Thus, when the male unit 80 is taken out from the male housing 70, the male terminal covering body 50 can automatically return to the protection position. Therefore, a special operation and tool for displacing the male terminal covering body 50 to the protection position can be omitted, and the male tabs 22 can be protected quickly.

The male terminal covering body 50 is formed with the deflectable and deformable semi-locking portions 53, and the male terminal supporting body 30 is provided with the restricting portions 41 configured to be locked to the interfering portions 54 of the semi-locking portions 53 at the protection position and to restrict a relative displacement of the male terminal covering body 50 to the exposed position. Thus, the male terminal supporting body 30 and the male terminal covering body 50 can be prevented from inadvertently sliding relative to each other when the male terminal covering body 50 is at the exposed position.

The restricting portions 41 are separated from the interfering portions 54 when the male terminal covering body 50 is at the protection position. Thus, frictional resistance generated between the male terminal supporting body 30 and the male terminal covering body 50 will not become excessive when the male terminal covering body 50 relatively slides, and the smoothness of relative sliding can be ensured.

The invention is not limited to the above described and illustrated embodiment. For example, the following modes also are included in the scope of the invention.

In the above embodiment, the male terminal supporting body is arranged on an upper side and the male terminal covering body is arranged on a lower side with respect to the male housing. Conversely, the male terminal supporting body may be arranged on the lower side and the male terminal covering body may be arranged on the upper side. Further, the male terminal supporting body and the male terminal covering body may be arranged on both left and right sides of the male housing. This similarly applies to the female housing, the female terminal supporting body and the female terminal covering body.

The pressing surface may be arranged at a position of the female connector facing the male terminal covering body in the connecting process and, depending on the structure, the pressing surface may be provided on the female terminal covering body or the female housing.

In the above embodiment, the male terminal covering body is provided with the semi-locking portions and the male terminal supporting body is provided with the restricting portions. Conversely, the male terminal supporting body may be provided with the semi-locking portions and the male terminal covering body may be provided with the restricting portions.

In the above embodiment, the engaging portions of the terminal covering body include the arms and are deflectable and deformable. Conversely, the engaged portions of the female connector may include arm portions and be deflectable.

The engaged portions may be arranged at such positions as to be engageable with the engaging portions of the terminal covering body and, depending on the structure, may be provided in the female terminal supporting body or the female housing.

LIST OF REFERENCE SIGNS

10 . . . male connector
20 . . . male terminal fitting
21 . . . body part
22 . . . male tab
30 . . . male terminal supporting body
41 . . . restricting portion
50 . . . male terminal covering body
53 . . . semi-locking portion
54 . . . interfering portion
63 . . . engaging portion
66 . . . covering part
70 . . . male housing
71 . . . accommodating portion
72 . . . receptacle
80 . . . male unit
100 . . . female connector
120 . . . female terminal fitting
133 . . . pressing surface
153 . . . engaged portion
180 . . . female unit

The invention claimed is:

1. A connector, comprising:

a male connector and a female connector connectable to each other, wherein:

the male connector includes a male terminal supporting body and a male terminal covering body slidable relative to each other, a male housing capable of accommodating the male terminal supporting body and the male terminal covering body, and a male terminal fitting having a body part supported in the male terminal supporting body and a male tab projecting from the body part;

the male terminal supporting body includes a rail, the male terminal covering body includes a guide;

separation of the male terminal supporting body and the male terminal covering body is restricted by engaging the guide with the rail, and the male terminal covering body is slidable relative to a protection position for covering the male tab by a covering part and an exposed position for exposing the male tab by the guide sliding on the rail;

the male housing includes a receptacle configured to surround the covering part of the male terminal covering body at the protection position with the male terminal supporting body and the male terminal covering body accommodated in the male housing; and the female connector includes a female terminal fitting to be fit into the receptacle and connected to the male tab at the time of fitting and has a pressing surface configured to displace the covering part toward the exposed position by pressing the covering part in the process of fitting the female connector into the receptacle.

2. A connector, comprising:

a male connector and a female connector connectable to each other, wherein:

the male connector includes a male terminal supporting body and a male terminal covering body slidable relative to each other, a male housing capable of accommodating the male terminal supporting body and the male terminal covering body, and a male terminal fitting having a body part supported in the male terminal supporting body and a male tab projecting from the body part;

the male terminal covering body is relatively slidable to a protection position for covering the male tab by a covering part and an exposed position for exposing the male tab;

the male housing includes a receptacle configured to surround the covering part of the male terminal covering body at the protection position with the male terminal supporting body and the male terminal covering body accommodated in the male housing;

the female connector includes a female terminal fitting to be fit into the receptacle and connected to the male tab at the time of fitting and has a pressing surface configured to displace the covering part toward the exposed position by pressing the covering part in the process of fitting the female connector into the receptacle;

the male terminal covering body is provided with an engaging portion; and the female connector is provided with an engaged portion configured to be engaged with the engaging portion in a direction separating from the receptacle and displace the male terminal covering body toward the protection position by a separating operation from the receptacle.

3. A connector, comprising:

a male connector and a female connector connectable to each other, wherein:

the male connector includes a male terminal supporting body and a male terminal covering body slidable relative to each other, a male housing capable of accommodating the male terminal supporting body and the male terminal covering body, and a male terminal fitting having a body part supported in the male terminal supporting body and a male tab projecting from the body part;

the male terminal covering body is slidable to a protection position for covering the male tab by a covering part and an exposed position for exposing the male tab;

the male housing includes a receptacle configured to surround the covering part of the male terminal covering body at the protection position with the male terminal supporting body and the male terminal covering body accommodated in the male housing;

the female connector includes a female terminal fitting to be fit into the receptacle and connected to the male tab at the time of fitting and has a pressing surface configured to displace the covering part toward the exposed position by pressing the covering part in the process of fitting the female connector into the receptacle;

one of the male terminal supporting body and the male terminal covering body is provided with a deflectable and deformable semi-locking portion and the other of the male terminal supporting body and the male terminal covering body is provided with a restricting portion configured to be locked to an interfering portion of the semi-locking portion at the exposed position and to restrict a relative displacement of the male terminal covering body to the protection position; and the restricting portion is separated from the interfering portion when the male terminal covering body is at the protection position.

* * * * *